US005127332A

United States Patent [19]

Corzine et al.

[11] Patent Number: 5,127,332

[45] Date of Patent: Jul. 7, 1992

[54] HUNTING BULLET WITH REDUCED ENVIRONMENTAL LEAD EXPOSURE

[75] Inventors: Alan J. Corzine, Marine; Gerald E. Eberhart, Bethalto, both of Ill.

[73] Assignee: Olin Corporation, Cheshire, Conn.

[21] Appl. No.: 772,183

[22] Filed: Oct. 7, 1991

[51] Int. Cl.[5] ..... F42B 12/34

[52] U.S. Cl. ..... 102/509; 102/517

[58] Field of Search ..... 102/501, 507–510, 102/514–517

[56] References Cited

U.S. PATENT DOCUMENTS

| | | | |
|---|---|---|---|
| 219,840 | 9/1879 | Winchester | 102/509 |
| 338,849 | 3/1886 | Lorenz | 102/514 |
| 1,135,357 | 4/1915 | Clyne . | |
| 1,328,334 | 1/1920 | Newton . | |
| 1,447,478 | 3/1923 | Koshollek et al. . | |
| 1,633,168 | 6/1927 | Dickerman . | |
| 1,833,645 | 11/1931 | Hartz . | |
| 2,327,950 | 8/1943 | Whipple . | |
| 2,765,738 | 10/1956 | Frech, Jr. . | |
| 2,838,000 | 6/1958 | Schreiber . | |
| 3,003,420 | 10/1961 | Nosler . | |
| 4,044,685 | 8/1977 | Avcin . | |
| 4,136,616 | 1/1979 | Schirneker | 102/510 |
| 4,625,650 | 12/1986 | Bilsbury | 102/516 |
| 4,655,140 | 4/1987 | Schirneker . | |
| 4,685,397 | 8/1987 | Schirneker . | |
| 4,753,172 | 6/1988 | Katzmann et al. | 102/517 |
| 4,949,645 | 8/1990 | Hayward et al. | 102/517 |

FOREIGN PATENT DOCUMENTS

| | | | |
|---|---|---|---|
| 27342 | 9/1907 | United Kingdom | 102/514 |
| 6785 | 4/1912 | United Kingdom | 102/514 |

*Primary Examiner*—Harold J. Tudor
*Attorney, Agent, or Firm*—John R. Wahl

[57] ABSTRACT

A controlled expanding small caliber bullet is disclosed which comprises a unitary metal body of generally H shaped cross section having an ogival nose portion, a cylindrical heel portion behind the nose portion, and an integral transverse partition therebetween. The nose portion has an empty hollow point formed by a forwardly open central blind bore. The heel portion has a rearwardly opened cavity filled with a dense material such as lead. The cavity is closed behind the lead core by a solid disk crimped into mechanical engagement with the heel portion of the metal body.

14 Claims, 1 Drawing Sheet

HUNTING BULLET WITH REDUCED ENVIRONMENTAL LEAD EXPOSURE

BACKGROUND OF THE INVENTION

This invention generally relates to hunting bullets and more particularly to a bullet having a hollow point.

Hunting bullets are generally small caliber, i.e. less than 0.50 caliber. They generally have a hollow point or soft metal nose portion to enhance energy absorption within the target animal tissue. Lead hollow point bullets have been marketed successfully for years. Lead hollow point bullets have one serious drawback. They all tend to upset and expand greatly within a short penetration distance and are not suitable for deep penetration. A hollow point, jacketed mushrooming bullet is disclosed in U.S. Pat. No. 1,633,168.

Soft point bullets such as the well know Nosler partition bullet, disclosed in U.S. Pat. No. 3,003,420 are utilized where deep penetration is required. Current soft point bullets expose lead and lead oxidation products to the environment after expansion.

Hunting bullets made primarily of a metal harder than lead have also been produced in order to achieve deep penetration with maximum tissue cutting action without splintering the bullet into pieces. For example, in U.S. Pat. No. 4,044,685, a jacketless bullet having a solid cylindrical copper alloy portion and a hollow nose portion filled with lead or other plastic deformable material is disclosed. This bullet is basically a hard metal hollow point bullet with axial grooves in the interior walls of the lead filled hollow point to provide sharp cutting flags during expansion in the target. These flags enhance cutting of the surrounding tissue as the expanding projectile passes through. This prior art bullet design suffers from having a reduced mass due to the absence of lead in the body of the projectile which limits its impact energy. In addition, it carries a substantial amount of lead in the nose which is exposed to the environment and can wash off upon expansion.

Another recent U.S. Pat. No., 4,655,140 discloses a partition type bullet similar to the Nosler partition bullet mentioned above. The hollow nose has oblique grooves in the outer surface of the ogive. A lead insert is disposed in the nose and a lead core is provided behind a central partition portion of the copper alloy partition bullet. Again, the lead disposed in the nose of the bullet is externally exposed upon expansion and deforms or upsets in a conventional manner upon impact. Further, the lead core behind the partition is exposed to the environment to the rear. Thus, upon impact in a target animal, a substantial amount of lead is exposed as well as washed into the adjacent tissues during bullet passage.

A lead-free bullet for hunting is disclosed in U.S. Pat. No. 4,685,397. This bullet is a solid one piece hollow point projectile made of tombac or copper. Closing the front end of the blind bore in the nose of the projectile is a steel plug which has wedge shaped ribs. Upon expansion, the steel plug is forced rearward into the central bore. The ribs cause the nose portion to split and curl backwards as curling petals which provide multiple cutting surfaces to lacerate tissue. However, this bullet has low mass and insufficient mass for deep penetration within a target.

Accordingly, there is still a need for a deep penetrating expanding bullet that does not permit exposure of lead while still providing substantial tissue damage.

Accordingly, it is an object of the present invention to provide a small caliber bullet which minimizes the potential of airborne environmental lead contamination.

It is another object of the present invention to provide a bullet with an encapsulated lead core which minimizes contamination of animal tissue by eliminating lead exposure, lead wash and jacket fragmentation.

It is a still further object of the present invention to provide a small caliber bullet which has no frontal lead wash during expansion.

It is a still further object of the present invention to provide a small caliber bullet which has improved impact trauma associated with penetration of the bullet into soft body tissue.

SUMMARY OF THE INVENTION

The bullet in accordance with the present invention is a controlled upsetting small caliber bullet comprising a unitary metal body of generally H-shaped axial cross section. The bullet has an ogival nose portion, a generally cylindrical heel portion behind the nose portion, and an integral partition portion therebetween. The body of the bullet is preferably made of a copper alloy such as brass or other ductile metal.

The nose has an unfilled hollow point formed by a rearwardly extending central blind bore extending from the front tip axially rearwardly approximately the full length of the nose portion. The nose terminates at a transverse partition between the nose portion and the heel portion. This transverse partition may support an external circumferential cannelure or groove for crimping the projectile into a cartridge case.

The heel portion may be straight or boattailed and has a rearwardly opened cavity which is filled with a core material which is more dense than the metal body. For example, the core material may be lead which is poured as a liquid into the preformed cavity in the heel portion, or a solid slug of lead which is swaged into the heel.

The core may also be tungsten, depleted uranium, bismuth, other heavy metal or a sintered material. The rear opening of the heel portion is closed by a flat disk of non metallic material or metals such as ferous or non-ferous materials, copper, brass, or other material identical to or similar to that of the metal body. This disk has an annular outer flange which is crimped into mechanical engagement with a rim portion of the heel portion to lock the core within the cavity.

The lead or other heavy metal core is thus completely enclosed within the bullet such that upon expansion of the bullet in soft body tissue, the nose portion upsets, i.e. peels back in several discrete petals which terminate at the partition portion. The core remains completely enclosed. Thus, upon impact there is controlled expansion of the bullet. In addition, because the bullet body is made of a ductile metal such as copper, brass, etc., the petals form sharp cutting edges which, because of the rotational momentum of the bullet, cause substantial cutting of adjacent body tissue a the upset bullet passes through. In addition, no lead is exposed upon launch or upon impact.

The bullet of the invention may be advantageously used in pistol and rifle ammunition for both hunting and law enforcement purposes. In addition, as lead is not exposed, this bullet is desirable for use in indoor shooting ranges.

DETAILED DESCRIPTION OF THE INVENTION

Figure 1:
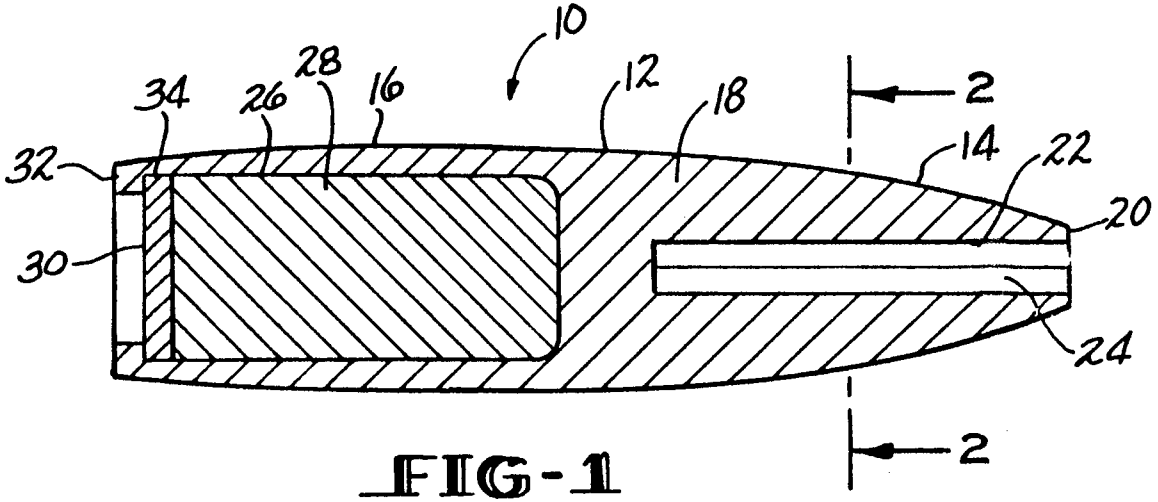
FIG. 1 is a longitudinal sectioned view of a bullet constructed in accordance with the present invention.

A controlled expanding or mushrooming small caliber bullet constructed in accordance with the present invention is illustrated in FIG. 1. Bullet 10 has a unitary metal body 12 of generally H-shaped axial cross section. The bullet has an ogival nose portion 14, a generally cylindrical heel portion 16 and an integral transverse partition portion 18 therebetween tandemly arranged along a central axis therethrough.

Figure 2:
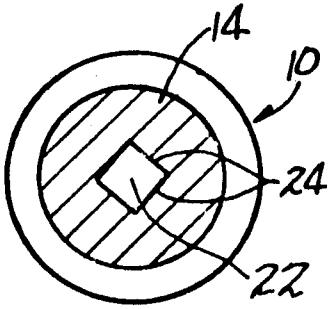
FIG. 2 is a transverse sectional view through the bullet shown in FIG. 1 taken along the line 2—2.
Figure 3:
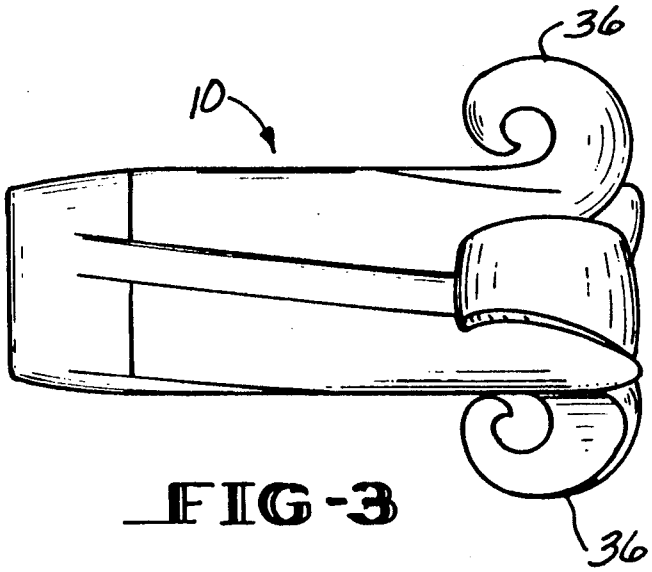
FIG. 3 is a side view of a bullet constructed in accordance with the invention after upset in body tissue.

The nose portion 14 terminates at its forward end in an annular tip 20 formed around a rearwardly extending forwardly open central blind bore 22. The central bore 22 extends rearwardly to the partition 18. The blind bore 22 may have a circular transverse cross section or that of a polygon. A square transverse cross section is shown in FIG. 2 created by axially extending flat side walls 24. A polygon is preferred as the corners of the polygon provide stress concentrators during upset to predictably form the petals as shown in FIG. 3. The heel portion 16 has a rearwardly open cavity 26 which contains a core 28 of lead, depleted uranium, tungsten, other heavy metal, or sintered material which is heavier than the metal of the unitary metal body 12. This core 28 provides the heavy mass necessary to achieve deep penetration of the bullet upon target impact. However, when lead is used as the core material, the lead must be sealed from the environment. A closure disk 30, positioned behind the core 28, mechanically engages a rim 32 of the heel portion 16 in order to seal the lead from the environment. The core 28 may also be made of powdered tungsten particles which can be held together as a solid body by a suitable binder such as plastic.

Figure 4:
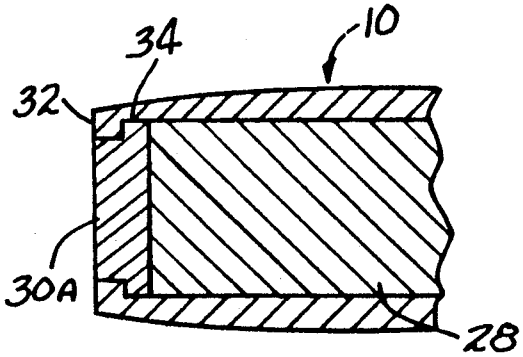
FIG. 4 is a longitudinal sectional view of an alternative heel portion of the bullet according to the invention.

The rim 32 is crimped over a radially outward extending flange portion 34 of the disk 30 so as to enclose the core 28. This disk 30 may simply be a flat disk with the rim 32 crimped thereover as shown in FIG. 1 or may have a hat shaped disk 30A as shown in FIG. 4 forming a flat rear surface on the bullet 10. This disk 30 is preferably made of the same material as the unitary metal body 12 in order to minimize the chance of forming a galvanic cell which could deleteriously promote corrosion of the bullet body and/or the core material and adversely affect the propellant in the cartridge case. Alternatively, the disk 30 may be made of a nonconductive material such as a plastic.

The positioning of the transverse partition 18 must be so chosen so that the center of pressure and the center of mass are optimized to preclude the tendency of the bullet to tumble during flight. In this regard, the separation distance between the center of pressure and the center of mass should preferably be between 0.5 and 1 calibers.

While the present invention has been described above with reference to particular embodiments thereon, it is apparent that many changes, modification, and variations can be made without departing from the inventive concept disclosed herein. Accordingly, it is intended to embrace all such changes, modifications, and variations that fall within the board scope of the appended claims. All patents, patent applications, and other publications cited herein are incorporated by reference in their entirety.

What is claimed is:

1. A controlled expanding small caliber bullet comprising:

a unitary metal body of generally H shaped axial cross section having an ogival nose portion, a generally cylindrical heel portion behind said nose portion and an integral partition therebetween along a central axis therethrough;

said nose portion having an empty hollow point formed by a rearwardly extending forwardly open completely empty central blind bore having axially parallel flat internal sidewalls;

said heel portion having a rearwardly open cavity therein filled with a dense material more dense than said metal body, said cavity being closed by a solid disk positioned axially behind said dense metal material in engagement with said metal body.

2. The bullet according to claim 1 wherein said blind bore in said nose portion has a polygonal radial cross section.

3. The bullet according to claim 2 wherein said bore has a square radial cross section.

4. The bullet according to claim 1 wherein said metal body is a copper alloy and said dense metal is lead.

5. The bullet according to claim 1 wherein said heel portion further comprises said disk having a flange portion in interference relation with a rim of said heel portion so as to enclose and secure said dense material within said body.

6. The bullet according to claim 5 wherein said disk has a .radially outward extending annular flange engaging an inwardly crimped annular rim of said heel portion to lock said dense material and said disk to said metal body.

7. The bullet according to claim 5 wherein said metal body is a copper alloy and said dense metal is tungsten.

8. The bullet according to claim 7 wherein said disk has an outwardly extending annular flange engaging an inwardly crimped annular rim of said heel portion to lock said dense material and said disk to said metal body.

9. The bullet according to claim 8 wherein said dense material is a solid body of powdered tungsten particles.

10. A controlled expanding small caliber bullet comprising:

a unitary metal body of generally H shaped axial cross section having an ogival nose portion, a generally cylindrical heel portion behind said nose portion and an integral partition therebetween along a central axis therethrough;

said nose portion having an empty hollow point formed by a rearwardly extending forwardly open completely empty central blind bore, said blind bore having axially flat internal sidewalls and a polygonal radial cross section;

said heel portion having a rearwardly open cavity therein filled with a dense material more dense than said metal body, said cavity being closed by a solid disk positioned axially behind said dense metal material and crimped into mechanical engagement with said metal body, said disk having a flange portion in interference relation with a rim of said heel portion so as to enclose and secure said dense material within said body.

11. The bullet according to claim 10 wherein said bore has a square radial cross section.

12. The bullet according to claim 11 wherein said metal body is a copper alloy and said dense metal is lead.

13. The bullet according to claim 12 wherein said disk is made of the same metal as said body.

14. The bullet according to claim 13 wherein said disk further comprises a central raised portion having a thickness the same as the rim crimped onto said flange portion so as to form a smooth transverse rear end surface on said bullet.

* * * * *